US006950017B2

(12) United States Patent
Smith

(10) Patent No.: US 6,950,017 B2
(45) Date of Patent: Sep. 27, 2005

(54) SYSTEM FOR MONITORING AN INHABITED ENVIRONMENT

(76) Inventor: Simon Lawrence Smith, The Byres, Roseberry Road, Norton, Stockton-on Tees TS20 1LB (GB)

( * ) Notice: Subject to any disclaimer, the term of this patent is extended or adjusted under 35 U.S.C. 154(b) by 137 days.

(21) Appl. No.: 10/396,263

(22) Filed: Mar. 25, 2003

(65) Prior Publication Data

US 2003/0189485 A1 Oct. 9, 2003

(30) Foreign Application Priority Data

Mar. 27, 2002 (GB) ..... 0207207

(51) Int. Cl.[7] ..... G08B 19/00

(52) U.S. Cl. ..... 340/521; 340/506; 340/3.1; 340/825.36; 340/825.49

(58) Field of Search ..... 340/506, 511, 340/517, 521, 3.1, 825.36, 825.49

(56) References Cited

U.S. PATENT DOCUMENTS 5,400,246 A * 3/1995 Wilson et al. ..... 700/17

FOREIGN PATENT DOCUMENTS

| | | |
|---|---|---|
| GB | 1446568 | 8/1976 |
| GB | 2151383 | 7/1985 |
| GB | 2324183 | 10/1998 |
| GB | 2343040 | 4/2000 |
| GB | 2348726 | 10/2000 |
| WO | WO 01/63578 | 8/2001 |

* cited by examiner

*Primary Examiner*—Daryl C Pope
(74) *Attorney, Agent, or Firm*—MacMillan, Sobanski & Todd, LLC

(57) ABSTRACT

A monitor system for monitoring an environment inhabited by an occupant includes a controller having data storage system, a processor, data processing software, at least one input, and at least one output, wherein at least one input includes an output signal from a signal generator associated with a utility meter, the utility meter being arranged to meter a utility entering the monitored environment, wherein the data processing software records and analyzes the or each at least one input, and wherein the at least one output includes an alarm signal generated when the data processing software determines that the utility use pattern is abnormal.

23 Claims, 3 Drawing Sheets

SYSTEM FOR MONITORING AN INHABITED ENVIRONMENT

FIELD OF THE INVENTION

This invention relates to monitoring activity and behavior patterns, and in particular to monitoring such activity and behavior patterns by measuring use of utilities and correlating such use with other indicative activities, or pre-recorded data, to generate an alarm signal.

BACKGROUND TO THE INVENTION

The population of the UK, and indeed most of the western world, is changing and the number of older persons is growing substantially. The projected number of people over 65 years of age in Great Britain is projected to increase by over 2 million (30%) from 7.8 million in 1996 to over 10 million in 2021 (Health Education Authority, 1998). In 1996 15% of all British households consisted of a lone person over pensionable age. Many older, infirm or disabled persons prefer to remain in their own homes rather than move to a nursing or residential home despite the probability of needing nursing or domiciliary help being greater among people who live alone (Grundy E, 1997, Population Trends, 84, 14–20). Whilst such older, infirm and disabled persons can in general live in their own homes satisfactorily, emergency situations can arise, where urgent external assistance is required, for example, elderly people living on their own who fall and cannot get up. To deal with this problem, it has become customary to provide older, infirm and disabled persons living in their own homes with alarm call buttons, which when activated call assistance from a call center, warden, or relative. As both the population and the trend to remain in ones home is growing, the number of persons living at home who may at some point require urgent external assistance is increasing.

As mentioned above, alarm call buttons for the disabled or elderly to summon assistance are widely used. However, these devices suffer poor compliance; that is their usefulness is severely restricted as they are infrequently carried or worn due to the user either being unwilling to carry and use the alarm, or simply forgetting to carry the device. If the user cannot activate the alarm in an emergency it is useless.

In an attempt to overcome the shortcomings of alarm call buttons, so-called 'Smart homes' are being developed, which use a number of sensors and switches around the home to detect person movement and activity. Such systems have full compliance as the person need only be in the environment for the system to monitor their activity and initiate an alarm call when an abnormal situation requiring assistance is detected. The problems with these systems are the complexity and cost associated with the many components, as well as their installation and commissioning.

Another known means of generating an emergency alarm signal monitors the activity of a person within a dwelling by monitoring the use of water in that dwelling. If water is not used for a pre-determined period, indicating a degree of incapacitation of the occupant, an alarm is raised.

In United Kingdom Patent No. 1,446,568 there is described a water supply system of a residence having a warning system. Flow of water into the dwelling is measured continuously. If there is no flow of water into the dwelling for period of more than ten hours, emergency assistance is assumed to be required, and an alarm call is raised.

In United Kingdom Patent Application No. 2,151,383 and United Kingdom patent application No. 2,324,183 there are also described detection devices which monitor flow of water into a dwelling, and raise an alarm call in the absence of water flow during a specified period.

United Kingdom Patent Application No. 2,343,040 describes a person inactivity alarm system which monitors the flow of water into a dwelling, and the movement of a person in the dwelling, in bed asleep. An alarm call is raised if water has not been used for a predetermined period, and the person is not asleep in bed.

United Kingdom Patent Application No. 2,348,726 describes the use of sensors arranged on furniture to monitor the activity of a person in a dwelling. In the absence of activity, an alarm call is raised.

WO 01/63578 describes a device, which senses current used by a device such as a television set, identifies abnormal behavior patterns and raises an alarm call.

The known devices for monitoring utilities (water, electricity etc) and raising an alarm call after a period of abnormal use are crude devices. The invention therefore seeks to provide an improved monitor and alarm device.

SUMMARY OF THE INVENTION

The invention provides a monitor system for monitoring an environment inhabited by an occupant. The system includes a controller having data storage means, a processor, data processing software, at least one input, and at least one output. The input includes an output signal from a signal generator associated with a utility meter. The utility meter is arranged to meter a utility entering the monitored environment. The data processing software records and analyzes the input, and the output includes an alarm signal that is generated when the data processing software determines that a utility use pattern is abnormal.

Another aspect of the invention provides a computer program for operating the monitor system of the invention in this manner.

BRIEF DESCRIPTION OF THE DRAWINGS

In the drawings, which illustrate one embodiment of a monitor system for monitoring an environment inhabited by an occupant according to the invention.

DETAILED DESCRIPTION OF THE PREFERRED EMBODIMENTS

Figure 1:
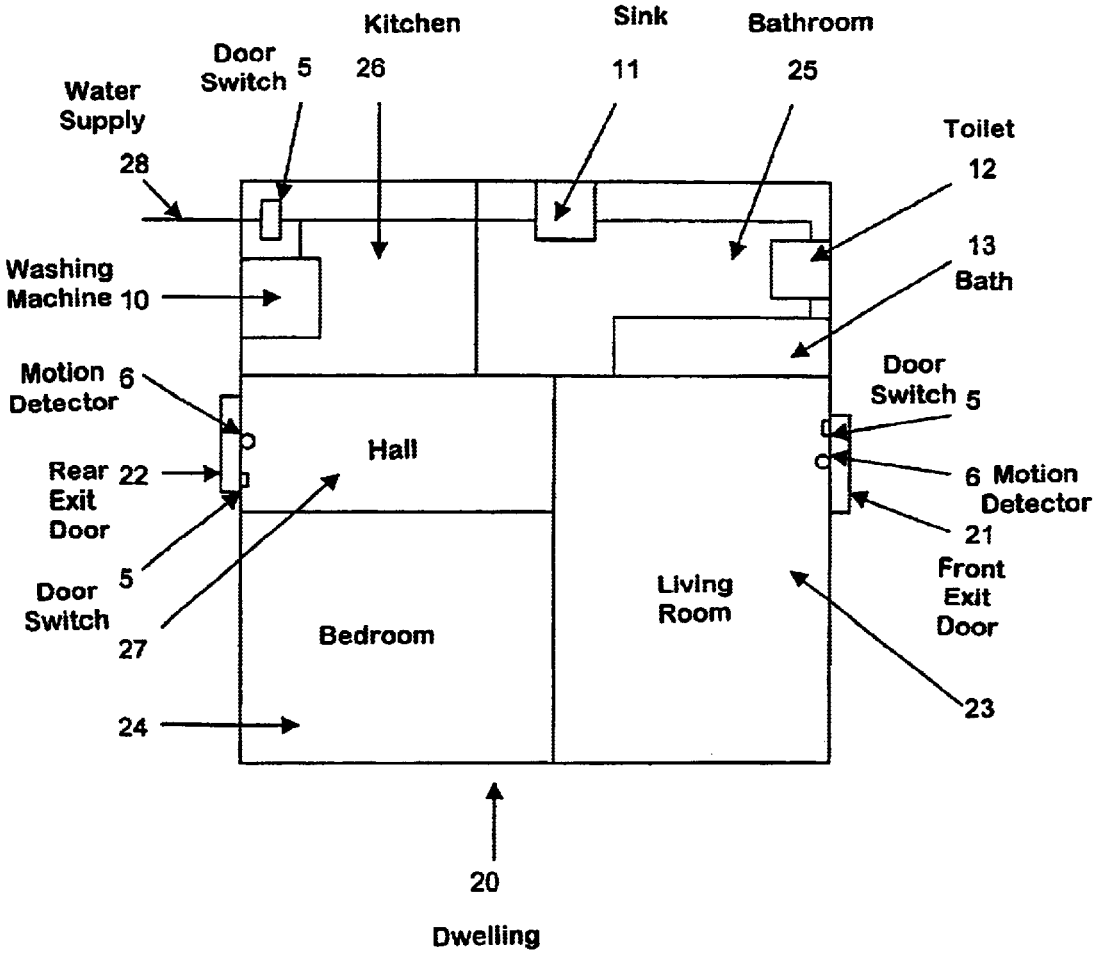
FIG. 1 is a plan view of a living environment monitored with a system according to the invention.

Referring now to FIG. 1, there is shown a plan view of a dwelling 20 having a front exit door 21 and a back exit door 22. Each door is equipped with a switch 5 which is closed when the door is closed and open when the door is open, or vice versa. The dwelling 20 comprises a living room 23, a bedroom 24, a bathroom 25, kitchen 26 and a hall 27. A motion sensor 6 is also located in the vicinity of each of the exit doors 21, 22. Motion sensor detect movement of objects, namely people, in the room, and in this example each motion detector is arranged to detect motion in the immediate vicinity of the exit doors 21, 22.

The dwelling 20 has a water supply 28. A water meter 7 is installed inside the house to meter water entering the dwelling 20 before any branching or water usage occurs, for example to the kitchen where a washing machine 10 is located, and the bathroom 25, where water consuming devices in the form of a sink 11, a toilet 12, and a bath 13 are located. The water meter 7 can be any type of water meter equipped with signal generating means for generating an electric or electronic signal indicative of water use. The signal from the water meter 7 may allow determination of water usage through variables such as volumetric flow rate, duration of flow and volume of water used.

The controller may include means to shut-off the mains water supply, if a continuous flow of water indicative of for example, an over flowing bath, is detected.

Figure 2:
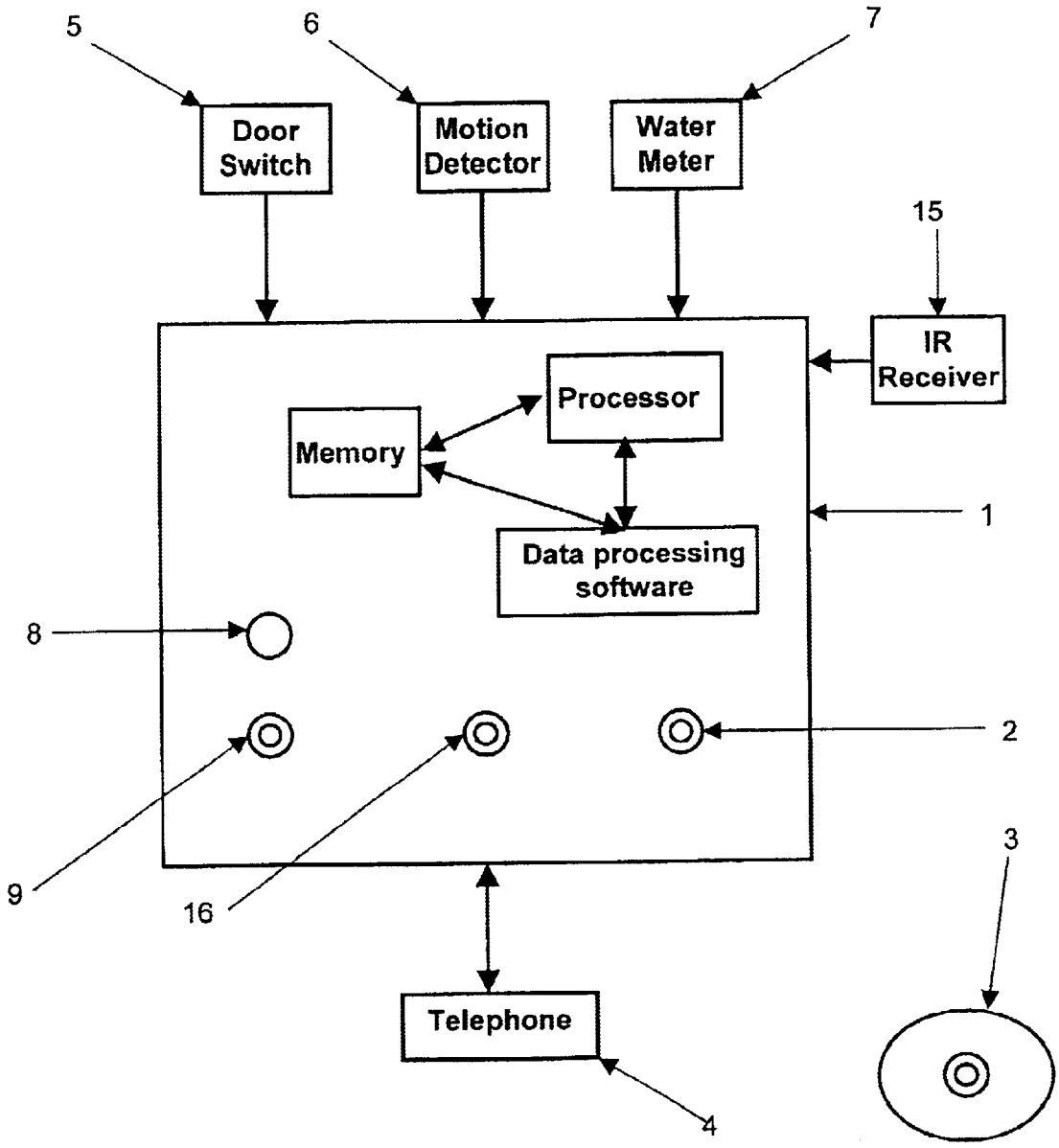
FIG. 2 is a layout diagram of a monitor system according to the invention.

Referring now to FIG. 2, an activity and behavior monitor and alarm device includes a controller 1 having a plurality of inputs including the outputs of an alarm raise switch 2, a remote control signal receiver 15, a door switch 5, a motion detector 6, a water meter 7 an alarm reset switch 9, and a system de-activation switch 16. The controller 1 further includes a plurality of outputs including an alarm warning means 8, and an alarm call raising means in the form of a telephone link 4.

The controller 1 also mounts a number of the devices from which it receives inputs, namely the alarm reset button 9, the alarm raise button 2, and the infra red receiver unit 15.

A remote control device 3 can active the manually operable functions of the device 1, namely the alarm reset and the raise alarm functions. The remote control 3 sends a signal to the remote control signal receiver 15, from which an electronic signal is transmitted to a micro-processor of the controller 1. The remote control device 3 could take the form of a pendant, a wristband or a hand-held remote control device.

The input devices of the controller 1, i.e. the raise alarm button 2, door switch 5, the motion detector 6, the water meter 7 having a means of generating an electrical or electronic signal representative of water consumption, the remote control receiver 15, are well known to those skilled in the art, and will therefore not be described in any greater detail in this specification.

The data processing software may be stored in any machine readable form. For example, the software may be embodied on a record medium such as a compact disc, stored in a computer memory, embodied in a read-only memory, or carried on an electrical signal.

In use, when a water consuming device is activated, for example the toilet 12, the water meter 7 generates a signal indicating water consumption. At the same time the switches 5 generate signals indicating that the doors 21, 22 are either open or closed, and the motion sensors 6 generate signals indicating movement or absence of movement within the house in the vicinity of the exit doors. These signals are received by the controller 1.

The controller includes data storage means and data processing means, including a microprocessor and data processing software. The inputs to the controller are received by the micro-processor and analyzed by the software. The controller may be programmed with the respective characteristic water consumptions associated with typical household activities (referred to hereinafter as "signatures"). For example, toilet flushing, bathing, showering, teeth cleaning, face washing, hand washing, clothes washing, dish washing, vegetable washing, garden watering, kettle filling, pan filling, bucket filling, cooking, drinking and so on. Each signature can be identified as a water use requiring the presence of a person in the environment, for example teeth cleaning, or a water use which does not necessarily require the presence of a person in the environment, for example cloths washing, where a washing machine may be switched on automatically when no one is present in the environment.

In use, as the controller 1 monitors water consumption, actual water consumption is compared against the programmed water consumption signatures. If the measured water consumption is within an acceptable threshold of the programmed signature for a device, then the software identifies the water use as being that of the matched signature, for example filling a kettle.

The software analyses actual water consumption and its pattern and frequency of consumption. The software identifies the type of water usage in the manner described above, and then analyses the frequency of specific signatures, for example teeth cleaning, and compares this with the recorded data for typical frequency of teeth cleaning for the occupants of the environment. If the patterns and frequency deviate beyond programmed limits, which may indicate a problem with the occupants health then external support can be advised.

As previously mentioned, the controller 1 also receives inputs from switches 5 and motion sensors 6. By monitoring the outputs of the switches 5 and motion sensors 6, more sophisticated automatic alarm signaling can be achieved. Most persons leave any given environment by one exit, if they are leaving that environment for an extended duration. A motion sensor 6 in the vicinity of the door 21, and a switch 5 associated with the door 21, enable the system to recognize that a person has left the environment. The controller 1 receives an input from the motion sensor 6 by the door 21 indicating motion in that area. The door is then opened causing the controller 1 to receive an output from the switch 5 indicating that the door 21 is open. As the person exits the environment through the door, the motion sensor 6 behind the door ceases to sense motion, and its output to the controller 1 changes. The person having exited the environment through the door 21 closes the door, thereby changing the status of the switch 5, and its output to the controller 1. If a person remains in the property the alarm will be immediately reset by water usage.

The system records water use, and whilst in the circumstances of a person leaving the environment as described above, the alarm is disabled if no one remains in the environment, the controller continues to record any water use, for example a washing machine or dishwasher may have been set off prior to the person leaving the environment, or be timed to switch on whilst the person is out. The system may therefore collect data on both water usage and house occupancy.

The system therefore monitors water usage over time, in order to generate the alarm signal. If the monitor recognizes that the environment is occupied but water usage has ceased for an abnormal period of time, indicating that the occupant of the environment may have come to harm, for example, he or she may have fallen over, an alarm condition is reached. The software of the controller then generates an output to activate the alarm 8 to alert occupants to the alarm condition. The alarm 8 may comprise a visual, audio or vibration device, or other known alarm devices such as systems for alerting deaf people. If a false alarm situation has arisen, the occupants may then reset the system using a reset button 9. This is another means of reducing the number of false alarms being communicated externally. If the alarm warning is not reset after a short period of time, the software generates an alarm call via the telephone connection 4 to a source of help, for example a warden, a family member, or call center. The alarm warning 8 and reset button 9 could be incorporated into a remote control 3.

By providing the controller 1 with a telephone connection 4, remote access to the system can be gained, thereby permitting remote checking of the device, updating device software and downloading data gathered by the controller.

In addition to raising an alarm call in the event of an accident, the system can also be used to monitor possible deterioration in health of the occupant of the environment. Certain patterns of water usage, for example bathing less frequently, or changes in drinking water consumption are indicative of failing health. The data collected by the system can therefore be analyzed by health professionals to assist in the diagnosis of health deterioration to identify patterns of behavior indicative of failing health. The software may be programmed to highlight patterns of water usage indicative of behavior indicative of failing health. The controller 1 could be programmed to automatically raise such problems with external support, such as the occupant's doctor, via the telephone connection 4. Equally, the controller may be interrogated in situ, and any relevant data view and/or downloaded for examination by a suitable health professional.

It is possible to fine tune the system's alarm response, and report generation by providing the facility for the software to statistically analyze the data continuously received by the system in real-time. The software is programmed to establish a statistical distribution of water usage in an environment. In the case of an alarm to indicate that an occupant is in danger, the software generates an alarm signal when the time between water uses in an occupied environment approaches a threshold value, for example the $95^{th}$ percentile value. Alternatively, the software may generate an alarm signal when, in an occupied environment, the time elapsed since the last water use equals the mean time between water uses plus the standard deviation.

Figure 3:
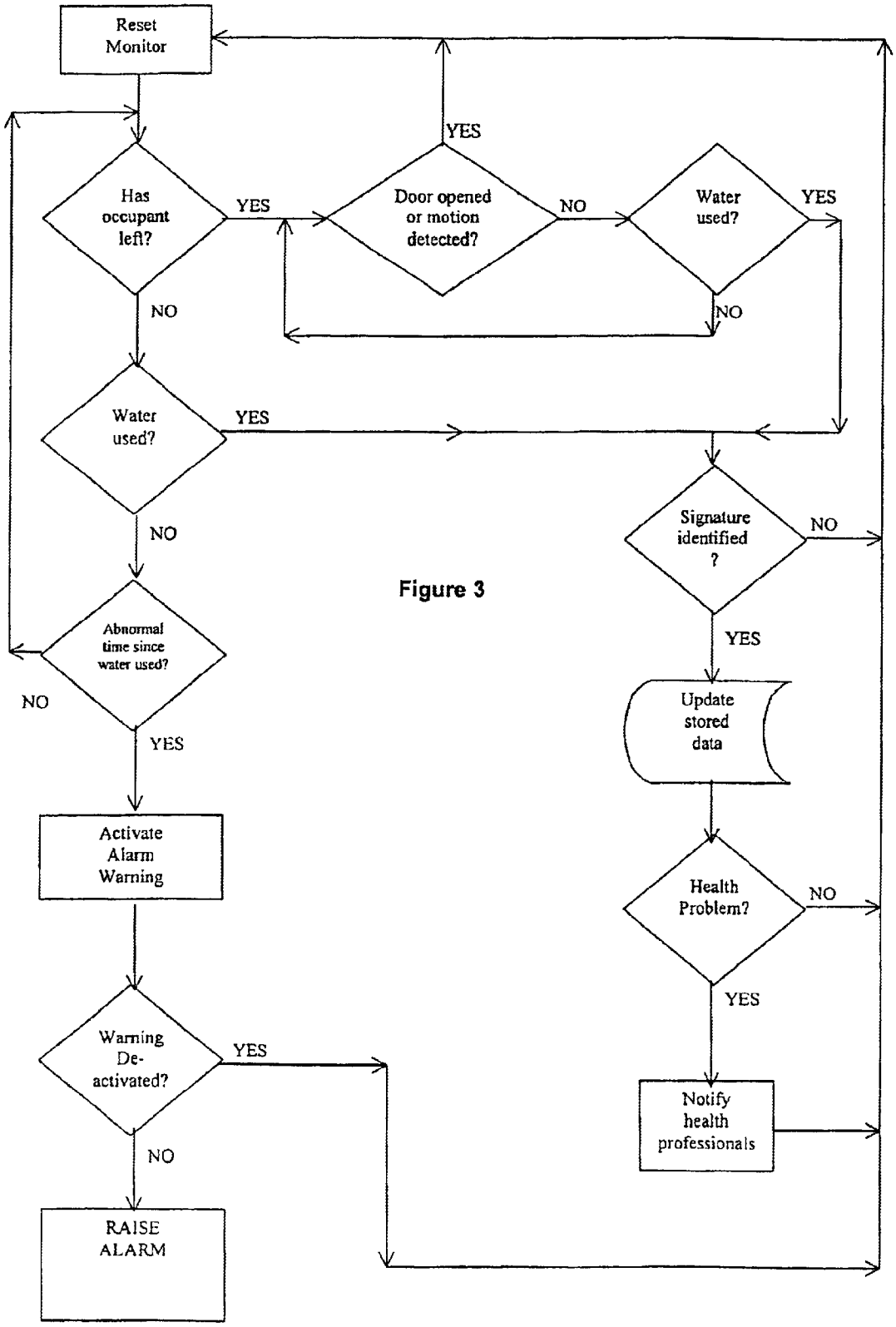
FIG. 3 is a flow diagram illustrating the algorithmic steps executed by the software of the system of the invention.

FIG. 3 illustrates the steps performed by the software in operation of the system of the invention.

The invention provides a system for monitoring an inhabited environment which is much more sensitive than the known prior art devices which monitor utility consumption in order to identify situations where the occupant of the environment is in danger, yet which is significantly simpler and therefore less costly to install than the so called "smart" systems of the prior art which monitor individual utility consuming devices.

What I claim is:

1. A monitor system for monitoring an environment inhabited by an occupant, the system comprising:

a controller having data storage means, a processor, data processing software, at least one primary input, at least one secondary input, and at least one output, wherein the at least one primary input comprises an output signal from a signal generator associated with a utility meter, the utility meter being arranged to meter a utility entering the monitored environment and not associated with any utility consuming device located within the monitored environment, wherein the said data processing software records and analyses the at least one primary input and the at least one secondary input, and wherein said at least one output includes an alarm signal generated when the data processing software determines that a utility use pattern is abnormal.

2. A monitor system according to claim 1, including at least one motion sensor located in the environment, wherein the said at least one secondary input includes an output signal from the at least one motion sensor.

3. A monitor system according to according to claim 1, including at least one switch associated with an exit door of the said environment, and wherein said at least one secondary input includes an output signal from the at least one switch, said switch changing its open/closed status upon opening or closing of its associated exit door.

4. A monitor system according to claim 1, wherein said at least one secondary input includes a signal from a manually operable alarm raise switch, and wherein when the said switch is activated the controller generates an alarm signal.

5. A monitor system according to claim 4, wherein the manually operable alarm raise switch is located on a remote control device, which transmits a signal to a receiver connected to the controller upon activation of said alarm raise switch.

6. A monitor system according to claim 1, wherein the at least one secondary input includes a signal from a monitor system de-activation switch, and wherein upon receipt of such a signal by the controller, the monitor system is switched off.

7. A monitor system according to claim 1, wherein the at least one secondary input includes a signal from an alarm reset switch, and wherein said reset switch is activated when the reset switch is activated upon generation of said alarm signal, and wherein changing the status of said alarm reset switch de-activates the said alarm signal.

8. A monitor system according to claim 1, wherein upon generation of said alarm signal, the data processing software activates an alarm warning.

9. A monitor system according to claim 8, wherein the said alarm warning comprises an assistance summoning tele-transmissible signal.

10. A monitor system according to claim 8, wherein said alarm warning includes a warning device in the environment selected from the group comprising: an audible warning, a visual warning, or a touch stimulus.

11. A monitor system according to claim 1, wherein the metered utility is selected from the group comprising: water, gas and electricity.

12. A monitor system according to claim 1, wherein said analysis of the or each input includes the step of identifying signatures of individual utility uses.

13. A monitor system according to claim 12, wherein the data processing software is programmed with signatures of a plurality of specific utility uses, and wherein recorded utility uses are compared with said signatures, and identified as a specific utility uses when a recorded usage is within a predetermined threshold of the signature of that specific utility usage.

14. A monitor system according to claim 12, wherein signature identified utility uses are recorded, and the recorded use is compared with data representing normal utility use, and when said recorded utility use in a period deviates from normal utility use by a threshold value, said deviation above the threshold is identified in the recorded data.

15. A monitor system according to claim 14, wherein changing use of a utility during said period indicates failing health of the occupant of the environment, and upon detection of such changing use, the data processing software generates a signal indicating said changing use for transmission to health professional.

16. A monitor system according to claim 12, wherein signatures are identified as utility uses requiring or not requiring the presence of an occupant in the environment.

17. A monitor according to claim 1, wherein the data processing software receives an input from a motion sensor, wherein detected motion indicates the presence of an occupant in the environment.

18. A monitor system according to claim 17, wherein the data processing software receives an input from a switch associated with an exit door of the environment, wherein the on/off status of the switch represents the open/closed status of the associated exit door, wherein the data processing software analyses signals from the switch and said motion sensor to determine that an occupant has exited the environment.

19. A monitor system according to claim 18, wherein the said motion sensor is located in the vicinity of said exit door, and wherein the data processing software continuously analyses signals from said motion sensor, and by detection of motion after detection of an occupant exiting the environment, detects that the environment nevertheless remains occupied.

20. A monitor system according to claim 1, wherein abnormal utility use is constituted by substantially no use of said utility during a predetermined period.

21. A monitor system according to claim 1, wherein the said data processing software includes a statistical analyses facility, which facility establishes a statistical distribution of utility use in the environment, and wherein abnormal utility use is determined to occur when the time between utility uses approaches a predetermined threshold statistical value.

22. A computer program comprising program instructions for operating a monitor system for monitoring an environment inhabited by an occupant, the system comprising:

a controller having data storage means, a processor, data processing software, at least one primary input, at least one secondary input, and at least one output, wherein the at least one input comprises an output signal from a signal generator associated with a utility meter, the utility meter being arranged to meter a utility entering the monitored environment and not associated with any utility consuming device located within the monitored environment, wherein the said data processing software records and analyses the or each at least one primary input and the at least one secondary input, and wherein said at least one output includes an alarm signal generated when the data processing software determines that a utility use pattern is abnormal.

23. A monitor system for monitoring an environment inhabited by an occupant, the system comprising:

a controller having data storage means, a processor, data processing software, at least one input, and at least one output, wherein one at least one input comprises an output signal from a signal generator associated with a utility meter, the utility meter being arranged to meter a utility entering the monitored environment, wherein the said data processing software records and analyses the or each at least one input, wherein said at least one output includes an alarm signal generated when the data processing software determines that a utility use pattern is abnormal during a period of time, and wherein changing use of a utility during said period of time indicates failing health of the occupant of the environment, and upon detection of such changing use, said data processing software generates a signal indicating said changing use for transmission to health professional.

* * * * *